US005396745A

United States Patent [19]

Klein

[11] Patent Number: 5,396,745

[45] Date of Patent: * Mar. 14, 1995

[54] HABITABLE STRUCTURE WITH WATER STORAGE AND DISTRIBUTION

[76] Inventor: John M. Klein, 105 Deer La., Newtown Square, Pa. 19073

[ * ] Notice: The portion of the term of this patent subsequent to Aug. 31, 2010 has been disclaimed.

[21] Appl. No.: 113,796

[22] Filed: Aug. 30, 1993

Related U.S. Application Data

[63] Continuation-in-part of Ser. No. 875,875, Apr. 29, 1992, Pat. No. 5,239,794.

[51] Int. Cl.[6] ..... E02D 15/04

[52] U.S. Cl. ..... 52/169.6; 52/16; 52/19; 52/20; 52/21; 210/167

[58] Field of Search ..... 52/19, 20, 21, 169.6, 52/16; 210/167; 169/13, 16, 37

[56] References Cited

U.S. PATENT DOCUMENTS

| | | | |
|---|---|---|---|
| 1,460,613 | 7/1923 | Sill . | |
| 3,227,061 | 1/1966 | Swayze . | |
| 3,878,898 | 4/1975 | Marshall | 169/16 |
| 3,918,525 | 11/1975 | Mecklen | 169/16 |
| 4,161,186 | 7/1979 | Sitarz . | |
| 4,162,218 | 7/1979 | McCormick . | |
| 4,175,703 | 11/1979 | Valiant | 169/16 |
| 4,178,994 | 12/1979 | Ito et al. | 169/16 |
| 4,228,006 | 10/1980 | Hanna . | |
| 4,330,040 | 5/1982 | Ence et al. | 169/13 |
| 4,428,434 | 1/1984 | Gelaude | 169/13 |
| 4,615,158 | 10/1986 | Thornton . | |
| 4,717,785 | 1/1988 | Paxson . | |
| 4,726,151 | 2/1988 | Vitale . | |
| 4,836,290 | 6/1989 | Le Lande, Jr. | 169/13 |
| 4,934,404 | 6/1990 | DeStefano . | |
| 5,125,458 | 6/1992 | Berman | 169/13 |
| 5,239,794 | 8/1993 | Klein | 52/169.6 |

*Primary Examiner*—Carl D. Friedman
*Assistant Examiner*—Wynn E. Wood
*Attorney, Agent, or Firm*—Panitch Schwarze Jacobs & Nadel

[57] ABSTRACT

A habitable structure has a ground-supported, water-impervious floor and upright foundation walls which together define an open top water enclosure. Flooring is supported on the foundation walls essentially covering the open top. Roofing is supported above the flooring so as to define a habitable space between the roofing and the flooring above the enclosure. Various systems for distributing water from the enclosure are disclosed and include the sprinkler system for distributing water outside as well as inside of the structure and heating-/cooling systems which can either circulate water from the enclosure as a heat transfer liquid or circulate fluids through water in the enclosure to use the water as a heat sink or heat source.

18 Claims, 4 Drawing Sheets

HABITABLE STRUCTURE WITH WATER STORAGE AND DISTRIBUTION

This application is a continuation-in-part of application Ser. No. 07/875,875, filed Apr. 29, 1992, now U.S. Pat. No. 5,239,794, which is incorporated by reference herein in its entirety.

FIELD OF THE INVENTION

The invention relates to habitable structures and, more particularly, with respect to water storage and distribution systems used with habitable structures.

BACKGROUND OF THE INVENTION

In many areas of this country, the development of real estate has been hindered or blocked due to the unavailability of on-site water.

For example, in certain prime residential areas around San Francisco, county officials will not issue housing construction permits because of the lack of piped-in water and the absence of accessible ground water. The same problems hinder development in many arid areas such as the southwestern United States, the Virgin Islands and elsewhere.

Similar problems exist in other locations. For example, in certain areas of the Hawaiian Islands and other locations, rainwater is plentiful, or at least adequate to support habitation, but piped-in water and ground water are unavailable due to expense, geology, contamination, etc.

Others have previously suggested the provision of tanks to collect rainwater, where available, for use in a habitable structure. However, exposed tanks like those disclosed in U.S. Pat. Nos. 1,760,613 and 4,726,151 are generally unsightly and can cover a relatively large portion of a tract. Moreover, the property in question may not be sufficiently large in area to contain both the habitable structure and the tank or to contain both and still comply with building or zoning codes. U.S. Pat. Nos. 4,228,006 and 4,934,404 disclose burying water storage tanks under or near a habitable structure. However, excavation may not be possible in some locations due to geology and may be a significant additional construction expense, even if possible.

The inability to provide adequate water in these cases has either prevented or limited the development of the property in question and has significantly depressed the market values of such properties. In some instances, properties which would be extremely valuable if they could be developed for habitable uses have been rendered almost worthless.

Yet another problem which has emerged in certain areas subject to drought, like many parts of the Southwestern United States, is the occurrence of brush fires which sweep over houses and other dwellings. Often such fires merely start the ignition of the roof and/or walls of such houses which thereafter continue to burn after the front of the brush fire has moved on. In many cases, fire fighting organizations are unable to save such structures because they are overwhelmed by the size of the areas affected by the fires or they do not have adequate access to the site of the fire or because of remoteness or danger from this fire itself. Even where fire equipment may be able to make its way to the fire scene, it may still lack adequate access to water or adequate pressure at the property to save the structure.

SUMMARY OF THE INVENTION

In its most basic form, the present invention is a ground-supported habitable structure comprising a foundation formed by one or more essential water-impervious vertical walls defining an essentially closed perimeter; a ground contacting, essentially water-impervious floor within the perimeter and defining with the foundation an open top water enclosure sitting on or at least partially in the ground. The structure further comprises flooring positioned on the foundation at least substantially covering the open top of the enclosure. The foundation supports an outer perimeter of the flooring and at least part of any load supported by the flooring. The structure further comprises roofing exposed to the elements and supported sufficiently high over the flooring to provide a habitable space between the roofing and the flooring. The roofing and any load supported by the roofing is transmitted to the ground through the foundation. The structure further includes a plurality of fire sprinklers, a pump, and a conduit system fluidly coupling together the pump, the water enclosure and the plurality of fire sprinklers so as to supply water to the plurality of sprinklers via the pump.

In its most basic form, the present invention is a ground-supported habitable structure comprising a foundation formed by one or more essential water-impervious vertical walls defining an essentially closed perimeter; a ground contacting, essentially water-impervious floor within the perimeter and defining with the foundation an open top water enclosure sitting on or at least partially in the ground. The structure further comprises flooring positioned on the foundation at least substantially covering the open top of the enclosure. The foundation supports an outer perimeter of the flooring and at least part of any load supported by the flooring. The structure further comprises roofing exposed to the elements and supported sufficiently high over the flooring to provide a habitable space between the roofing and the flooring. The roofing and any load supported by the roofing is transmitted to the ground through the foundation. The structure further comprises a fluid conduit system including at least a first part extending through the open top water enclosure and at least a second part located at a position below the roofing and above any water in the enclosure and below the roofing, a heat exchanger coupled into at least one of the first and second parts of the conduit system and a fluid transfer device coupled with the conduit system in a manner to transfer fluid through at least the first and second parts of the conduit system and the heat exchanger.

In its most basic form, the present invention is a ground-supported habitable structure comprising a foundation formed by one or more essential water-impervious vertical walls defining an essentially closed perimeter; a ground contacting, essentially water-impervious floor within the perimeter and defining with the foundation an open top water enclosure sitting on or at least partially in the ground. The structure further comprises flooring positioned on the foundation at least substantially covering the open top of the enclosure. The foundation supports an outer perimeter of the flooring and at least part of any load supported by the flooring. The structure further comprises roofing exposed to the elements and supported sufficiently high over the flooring to provide a habitable space between the roofing and the flooring. The roofing and any load supported by the roofing is transmitted to the ground through the foundation. The structure further comprises a closed fluid conduit system having a first part extending into the enclosure and a second part extending within the structure in a space existing between the enclosure and the roofing above any water in the enclosure. The structure further comprises at least one heat exchanger located along the first part of the conduit system in a position within the enclosure to exchange heat with water stored in the enclosure; at least a second heat exchanger located along the second part of the conduit system in a position above any water stored in the enclosure; and a fluid transfer device coupled with the closed fluid conduit system in a manner to circulate a heat transfer fluid through the closed fluid conduit system and first and second heat exchangers.

BRIEF DESCRIPTION OF THE DRAWINGS

The foregoing Summary as well as the following Detailed Description of Preferred Embodiments are better understood when read in conjunction with the appended drawings. For the purpose of illustrating the invention, there is shown in the drawings embodiments which are presently preferred. It should be understood, however, that the invention is not limited to the specific methods and instrumentalities disclosed. In the drawing.

DESCRIPTION OF PREFERRED EMBODIMENTS

Figure 1:
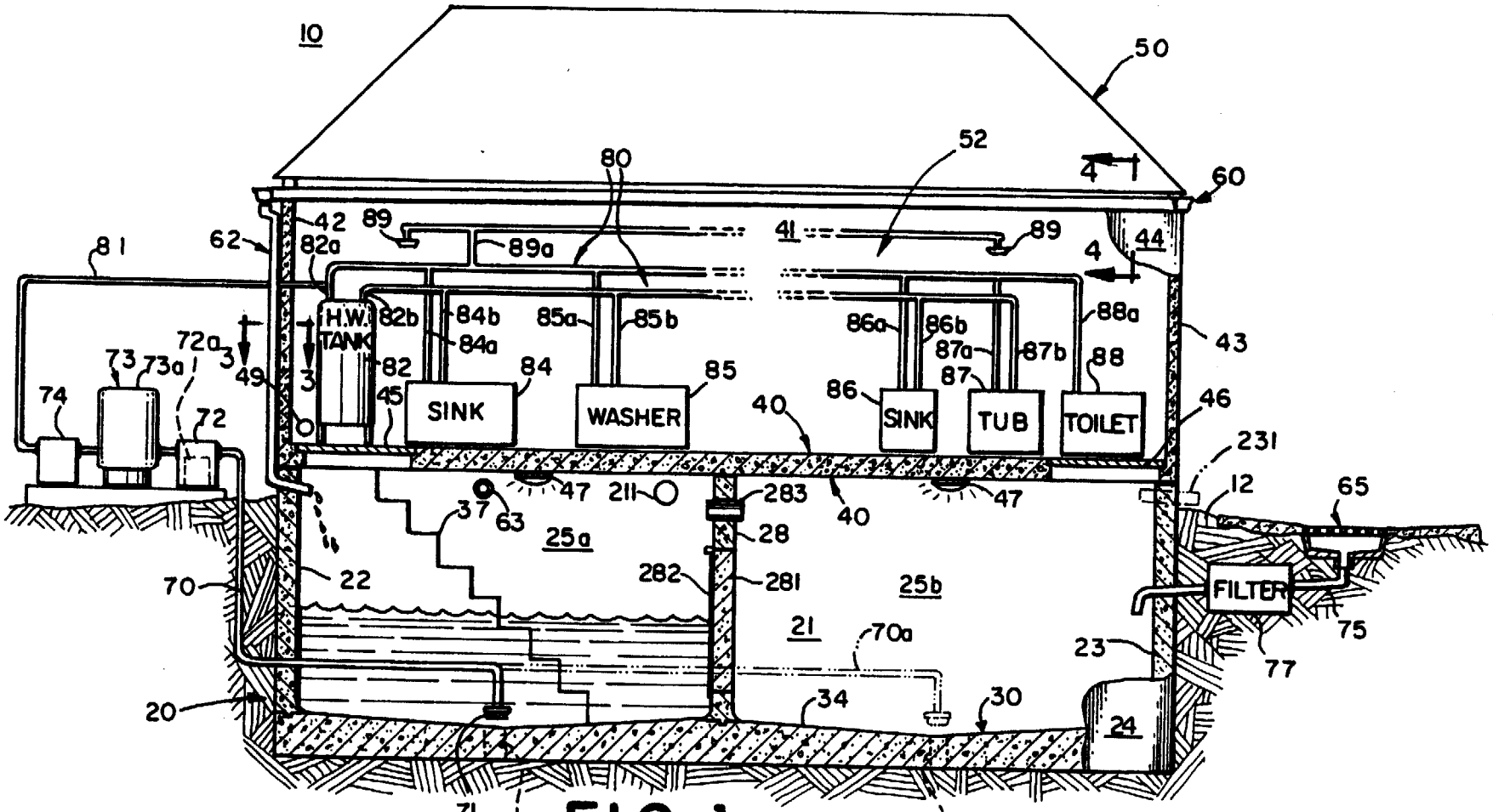
FIG. 1 is a diagrammatic broken-away elevational view of an exemplary, preferred embodiment, ground-supported, habitable structure of the present invention.

Certain terminology is used in the following description for convenience only with reference to the drawing and is not limiting. In addition, like numerals are used in the drawing to indicate like elements throughout.

There is shown in FIG. 1 a diagrammatic representation of a ground-supported habitable structure of the present invention indicated generally at 10. The structure 10 includes the ground contacting foundation, indicated generally at 20, a ground contacting, essentially water-impervious floor indicated generally at 30, flooring indicated generally at 40, which is positioned on the foundation 20 and roofing indicated generally at 50, which is exposed to the elements and supported sufficiently high over the flooring 40 to provide a habitable space 52 between the roofing 50 and flooring 40 (e.g. about six feet or more for someone to stand). The depicted foundation 20 is formed by four, at least essentially water-impervious vertical walls 21–24 which are mutually perpendicularly positioned to define an essentially closed, rectangular perimeter. Foundation wall 21 is seen in the background of FIG. 1 extending perpendicularly between walls 22 and 23, which are seen in cross section. A fourth wall, which has been almost entirely broken away in FIG. 1, extends perpendicularly between walls 22 and 23, parallel to wall 21, and is spaced out of the plane of FIG. 1 from a wall 21 to define with the indicated walls 21, 22, 23, the essentially closed perimeter. The floor 30 contacts and is supported directly by the ground 12. Preferably, floor 30 in turn supports foundation walls 21–24. The floor 30 and walls 21–24 might be integrally formed. The floor 30 and foundation 20 together define an open-topped, water enclosure contacting and supported by the ground 12, the open top being at least essentially covered by the flooring 40. In the depicted embodiment, an at least generally water-impervious, vertical load-bearing partition wall 28 is further preferably provided extending between foundation walls 21 and 24. It defines with the floor 30 and foundation walls 21–24, two separate, adjoining open top water enclosures, which are indicated at **25*a* and 25*b*. Of course, petition wall 28** can be omitted and only a single enclosure provided or more than two enclosures can be provided as desired and as space permits by additional petition walls.

The roofing 50 is supported above the flooring 40 on four upper load-bearing walls 41, 42, 43 and 44. The roofing 50 and any load supported by the roofing is transmitted to the ground 12 at least through those upper walls 41–44 and the foundation walls 21–24. A catchment indicated generally at 60 is supported by one or more of the upper walls 41–44 and/or the roofing 50, or in other conventional ways, entirely around the roofing, so as to receive all rainwater running from the roofing 50. At least one water carrying conduit 62 is provided extending from the catchment 60 to the interior of the enclosure formed by foundation 20 and floor 30, in particular the enclosure **25*a*, so as to deposit rainwater running from the roofing into the enclosure beneath the flooring 40**.

Preferably, the floor 30, foundation 20 and flooring 40 are all provided by poured reinforced concrete to surround the enclosure(s) **25*a*, 25*b* with strong, non-corroding or rotting materials. It is preferred in each instance that a keyway like keyway 33 be provided in an upper surface 34 of the floor 30 so as to receive a key 29 formed at the bottom of each separately poured foundation wall defining part of the enclosure. The key and key way prevent movement of water beneath the walls 21–24 and, in the case of partition wall 28, prevent movement of that wall across the floor 30** under hydraulic load.

Where concrete or other masonry is used to provide the ground contacting foundation 20 and floor 30, at least the inner facing surfaces of the foundation walls 21–24 and 28 and floor 30 are preferably finished with nontoxic materials which will render those surfaces and the wall essentially water impervious. For example, a stucco/mortar bonding agent such as Thorobond® might be applied directly to the concrete surfaces, a coating 36 mortar, stucco or other concrete mortar mix applied to the surfaces and one or preferably two coats of a sealer 37 such as Thoroseal® applied over the bonding agent and coating. Alternatively, some plastic coating material(s) or systems which may be applied directly to concrete may be found suitable for this purpose.

Preferably, all inner surfaces of the foundation walls 21–24 and 28 and the upper surface 34 of the floor 30 facing the interior of each enclosure 25*a*, 25*b* are configured to prevent stagnation and encourage drainage away from the vertical walls. For example, the aforesaid mortar or stucco material may be applied at the corners formed between each of the vertical foundation walls 21–24 and 28 and the upper surface 34 of the floor 30 can be built up and shaped to provide curved surfaces like surface 38 in FIG. 2. Similarly, intersections between adjoining, transverse vertical foundation walls, like the intersections between walls 22 and 21 and walls 28 and 21, are preferably provided in the same or a similar manner with vertically extending curved surfaces connecting the adjoining inner planar sides of those walls, like surface 39 in FIG. 3, eliminating any corners between those adjoining inner planar sides of any enclosure 25*a*, 25*b*.

The habitable structures of the present invention are designed and intended to remedy both potential short term and long-term water shortage and/or storage problems. Because the preferred structure 10 is sufficiently strong and durable to last literally hundreds of years, the structure 10 is further preferably modified during initial construction to render one or both enclosures 25*a*, 25*b*, or as many of the number of separate enclosures provided usable as additional habitable space when the water is not being stored. For that purpose, one and preferably two access ways 45 and 46 may be provided through the flooring 40 to permit access through the flooring 40 to either enclosure(s) 25(*a* and/or *b*). Preferably too, one or more stairways 37, for example, poured or precast concrete, plastic or coated metal stairway(s), are installed leading from each access way to the floor 30.

Preferably too, provisions are further made for inspecting and cleaning each enclosure from its access. First, lighting is preferably provided within each enclosure. In the depicted embodiment, separate fixtures 47 are included over each enclosure 25a and 25b. Also, suitable means such as a water suction coupling, indicated diagrammatically at 49, is positioned proximal the access way 45 to permit the coupling of a swimming pool sweep or other comparable water suction device to clean sediment from the upper surface 34 of the floor 30 through the access way 45. A similar coupling can be provided adjoining the second access way 46, if desired.

Since it may be desired at some future time to use the entire enclosure 25 as additional habitable space and permit passage through partition wall 28, a door opening 281 may be provided which preferably may be sealingly closed by means of a removable cover 282. If desired, similar openings might be provided through any of the perimeter walls 21–24 as future window or door openings. Also preferably provided through partition wall 28 are one or more overflow tubes 283. Each tube 283 will permit the water levels in the adjoining enclosures 25*a*, 25*b* to balance in the event that one reservoir should fill when the other does not. Each tube 283 may be closed, for example, by means of a cover on either end of the tube or an adjustable valve (neither depicted) in the tube, if enclosure 25*b* is to remain dry.

Where only one enclosure 25*a* is being used to store water, preferably overflow piping 211 is also provided through one of the foundation walls 21, 22, 24 defining that enclosure 25*a*. Preferably, the overflow piping 211 has a collective cross-sectional area at least as great as the cross-sectional area of the inlet conduit 62 to drain water from near the top of the enclosure 25*a* at least as quickly as the enclosure of 25*a* can be filled. The piping 211 is preferably covered at its outer end with a fine screen that permits water to flow out of the enclosure 25*a* but prevents vermin and other like potential contaminating elements from passing back into the enclosure 25*a*.

In addition to collecting and directing water from the roofing of the habitable structure 10 into its foundation, where necessary or desirable, water from the roofs of ancillary and outbuildings can also be collected and conducted to the enclosure 25*a*. For example, an inlet like inlet 63, indicated diagrammatically, can be provided with appropriate valves and fittings to receive a hose to add water to the enclosure 25*a* from another Separate source, such as a tank truck, a well, a separate piped water supply, etc. Alternatively or in addition, water can be pumped through piping 211. In addition, if desired, sources of clean runoff water from the ground may also be collected by suitable means. For example, a drain 65 in a paved area collects water which is carried by suitable underground conduit(s) 75 to the enclosure 25*b* where it may be stored separately from the intended potable water supply enclosure 25*a* for secondary uses, such as outside washing, irrigation, fire protection, etc. An appropriate filter 77 can be provided to initially clean the water to the degree desired for its intended storage and use.

Water may be removed from each enclosure by suitable, conventional means. In the indicated preferred embodiment, a removal pipe 70 is extended into the enclosure 25*a* with its open end located proximal the enclosure floor 30 to draw off water from near the bottom of the enclosure. A screen 71 may be installed at the inlet of the pipe to prevent the pickup of large, solid debris. The outlet end of pipe 70 is coupled to a suction-type water pump 72. The outlet of the suction pump is preferably coupled to the inlet of a pressure pump 73. The outlet of pressure pump 73 is preferably coupled to a filtration device 74. The outlet of filtration device 74 is coupled to the inlet end of a pottable water conduit distribution system within the structure 10, which is indicated generally at 80. The conduit system 80 includes a pressurized cold water feed line 81 from the outlet of the filtration device 74 having a number of sub-branches 82*a*, 84*a*, 85*a*, 86*a*, 87*a*, 88*a* and 89*a*, which carry the cold water to various fixtures within the enclosure including hot water tank 82, kitchen sink 84, clothes washer 85, and bathroom sink 86, tub 87, a toilet 88 and fire sprinklers 89, respectively. A separate hot water line 83 from the tank 82 also is provided with branches 84*b*, 85*b*, 86*b* and 87*b* routed to the respective indicated fixtures. Pressure pump 73 is of the type which includes an inverted, sealed tank having an inlet and outlet at the bottom end and retains a pocket of air or other gas(es) which is compressed by the water being fed under pressure into the tank 73*a* from pump 72. The compressed air or other gas(es) in tank 73*a* forces water from the bottom of the tank 73*a* through the filtration device 74 and the conduit system 80. An ozone generator, chlorinator or other conventional water disinfecting device may be coupled with the tank 73*a*, filter 74 or to another portion of the water distribution system for further safety, if desired.

In addition to the basic features of the system which have been shown and described, a number of ancillary features may be useful. For example, appropriate coupling, as is indicated at 81*a*, with a valve and female threaded spigot can be provided for outdoor use and for feeding externally pressurized water into the system, for example, from an auxiliary pump (not depicted). For example, valving which might be provided along conduits 62, 75 or conduit system 80, to vary or stop water flow therethrough, have been omitted from the figures. It might be quite desirable to include a bypass valve in conduit 62 to divert water from the conduit 62 onto the ground when the enclosure 25*a* has reached a desired maximum level or when the foundation is no longer used for water storage. Similarly, a shutoff or bypass valve along conduit 75 would be useful to prevent undesired water from entering enclosure 25*b*. In addition, it may be desirable to include a self-closing, timed shutoff valve on each of the feed lines 84*a*–88*a* and 84*b*–87*b* to prevent water from flowing more than a predetermined period of time through the conduit in the event of a faucet left open or a valve within a washer or toilet malfunction. Other conduit systems can be provided within the structure 10. For example, an internal water sprinkler system 89 can be provided, if desired, as a branch of conduit 81 or, alternatively, from the drain water enclosure 25*b*, preferably with its own pump. It may be desirable to have an auxiliary power supply 72*a* (in phantom) to power pump 72 or any other electrically powered appliance or motor in the event of a power outage during an emergency. Pump 72 can be used as the vacuum source 49 by the provision of suitable piping and valving. A separate branch 70*a* of the removal pipe 70 can be provided extending into enclosure 25*b*, with suitable diverting and/or shutoff valving to permit water to be drawn from such an enclosure if it is a source of pottable water or in the event that the pottable water in enclosure 25*a* is fully depleted. Sealable drains 125*a*, 125*b* (in phantom) can be provided through the floor 30 at the lowest point of each enclosure or through an exposed wall, if the wall is exposed above the ground at its base, to drain each enclosure by gravity. The layout of pipes and conduits is entirely diagrammatic. One of ordinary skill in the art will appreciate that piping such as 70, 70*a* would be better installed by being dropped from proximal the flooring 40 and/or passed within the foundation walls, rather than being passed horizontally through the foundation wall(s) at the bottom of the enclosure.

In addition, it may be desirable to provide electrical outlets suitable and conduits in the enclosure area or areas during construction for use when the enclosure is not dedicated to water storage. This can be done by the use of waterproof conduit, which may be sealed to permit the future addition of switch and plug boxes or which may include switch and/or plug boxes sealed for immersion prior to use. Of course, such circuits would be rendered inactive at the electrical distribution box for the enclosure 10. Also, prewired conduit boxes, switches and plugs can be provided supported from the flooring 40. The conduit can be threaded or otherwise provided with a pivotal joint which would permit a length of the conduit and a box with a plug or switch at the end to be pivoted downwardly from between the load-bearing members of the flooring 40 to a desired location in any enclosure 25*a*.

Figure 2:
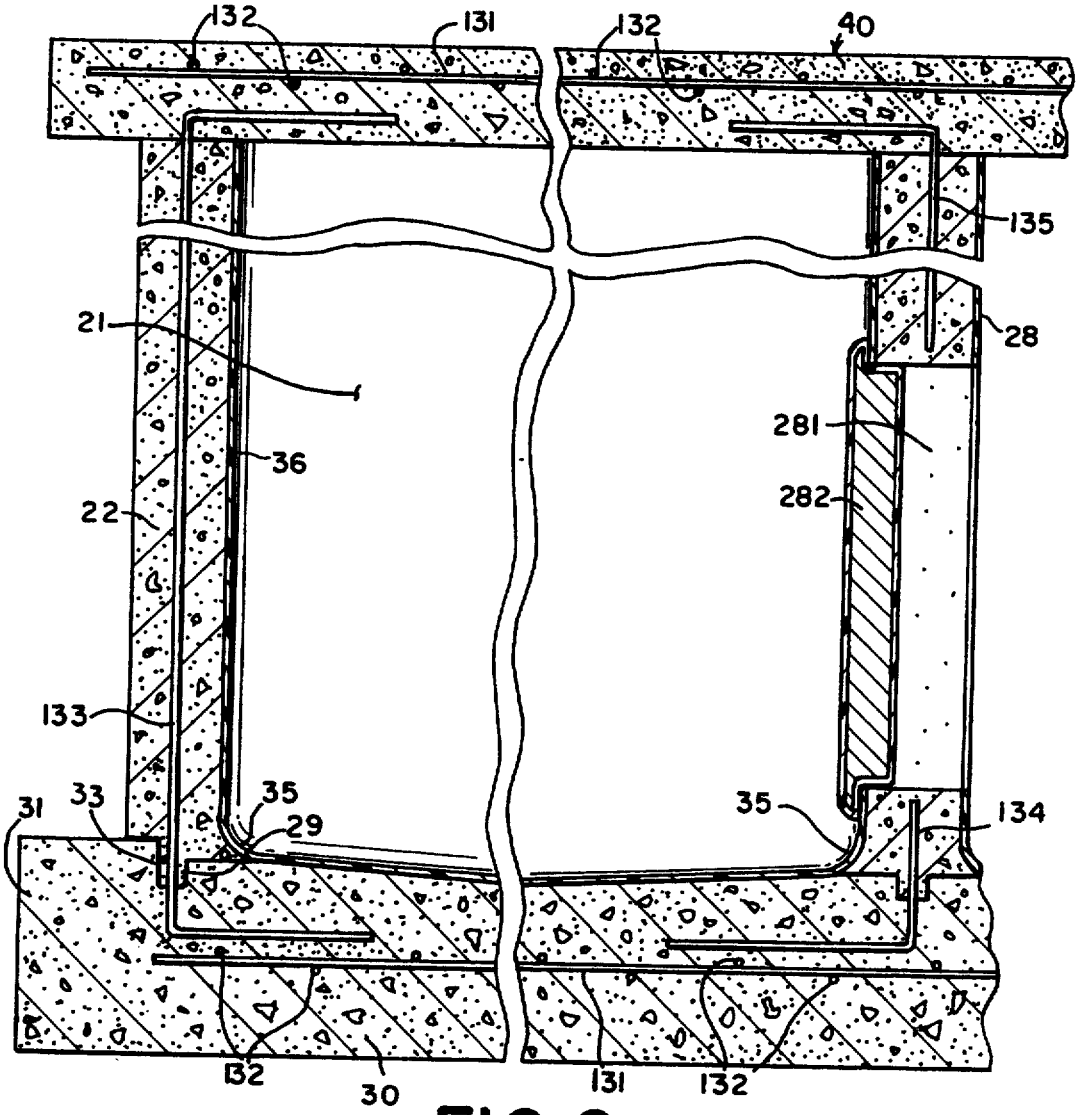
FIG. 2 is a more detailed, elevational, cross-sectional view of the building of FIG. 1 showing details of a preferred, reinforced concrete construction of the foundation and flooring.
Figure 4:
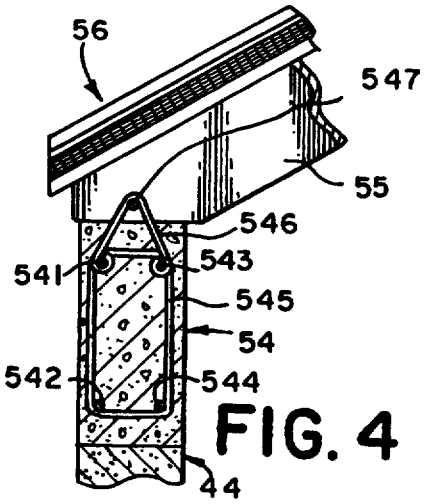
FIG. 4 is a vertical cross-sectional view along the lines 4—4 of FIG. 1.
Figure 3:
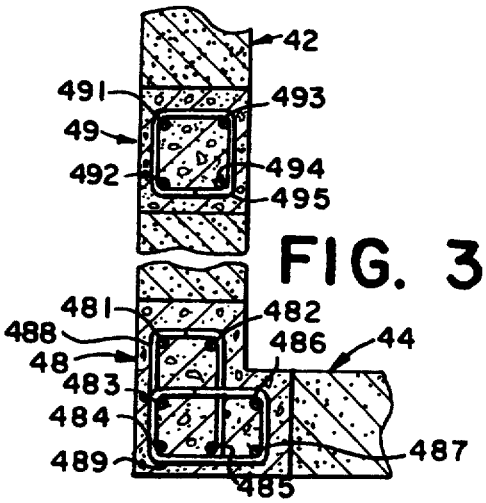
FIG. 3 is a plan cross-sectional view along the lines 3—3 of FIG. 1.

FIGS. 2 through 4 depict details of the preferred reinforced concrete construction of structure 10. FIG. 2 is a side elevation through walls 22, 28 near the intersection of each of those walls with wall 21. FIG. 3 is taken through the junctions of walls 42/44. FIG. 4 is taken along the top of wall 44.

Referring to FIG. 2, foundation floor 30 is preferably formed with an oversized footer portion 31, which extends around the lower perimeter of the enclosure 25 centered under each of the foundation walls 21–24 and under partition wall 28. Preferably, a variety of steel reinforcement bars strengthen each slab or wall element and interconnect the various load-bearing elements of the structure. For example, substantially horizontal reinforcement bars 131 are alternated at right angles with horizontal reinforcement bars 132 spanning the floor portion 30 of the enclosure. Bars 133, bent at right angles, are provided at regular intervals extending from the floor 30 upwardly into the foundation walls 22–25 and 28. Vertical bars 133 are provided at regular intervals along each of the walls 22–25. Preferably, their upper ends are turned horizontally into the slabsforming the flooring 40 over the foundation 20. Horizontal bars 131, 132 cross in the flooring slab 40 as well. Shorter right-angle bent reinforcement bars 134 and 135 connect the lower and upper portions of the partition wall 28 with the foundation floor 30 and flooring slab 40, respectively. Portions of the partition wall 28, located immediately to either side of the passageway 281, preferably are reinforced by columns like column 49 in FIG. 4, which will be subsequently described. The remainder of partition wall 28 is reinforced in the manner of wall 22 in FIG. 2.

Referring to FIG. 3, the upper walls 41–44 preferably include continuous L-shaped columns 48 at each of the four corners of structure 10 where the walls 41–44 intersect one another. In addition intermediate columns 49 are preferably provided adjoining each window or door opening through each of the walls 41–44, on either side of the opening, and, preferably, at regular intervals along long, unbroken expanses of such walls 41–44. Each corner column 48 preferably is formed by at least seven generally rectangularly arrayed, continuous, vertical reinforcement bars 481–487, which are preferably extended continuously from the foundation floor slab 30 through the foundation walls 21–24, the upper flooring slab 40, and the upper load-bearing walls 41–44 and into ring beam 54, tying the columns 48, 49 into the roofing 50. The reinforcement bars preferably are tied together in sets of five bars 481–485 and 483–487 by rectangularly bent reinforcement bars 488 and 489, respectively, at regular vertical intervals, for example, six inches. Each intermediate column 49 is preferably formed by four reinforcement bars 491–494, which are also preferably extended continuously from foundation floor slab 30 into the roofing 50, and which are also preferably wrapped at regular height intervals, for example six inches, with reinforcement tie bars 495 bent into a square shape around the vertical bars 491–494. One of ordinary skill will understand that "continuous" reinforcement bars can be provided by tying together individual bars in a conventional fashion. If desired, concrete lintels can be provided between adjoining intermediate columns 49 or between a corner column 48 and an intermediate column 49 above each door opening and above and below each window opening. Preferably, each lintel would be provided with reinforcement bars extended horizontally into the adjoining vertical columns and tied into the reinforcement bars of those columns.

Referring to FIG. 4, in addition to the foregoing reinforcement of the foundation, flooring and upper walls, a reinforced concrete ring beam 54 is preferably provided around the top of the upper load-bearing walls 41–44, locking those walls 41–44 together and to the framework supporting the roofing 50. Beam 54 preferably includes at least four, rectangularly arranged, horizontally running reinforcement bars 541–544, which are ringed at regular horizontal intervals by generally rectangularly bent reinforcement bars 545. Additional reinforcement bars 546 are bent in an acute angle and are provided at regular intervals between adjoining joists 55 of the roofing 50 with extreme ends wrapped around the upper reinforcement bars 541, 543. Each bar 546 protrudes upwardly from the continuous, integral portion of the ring beam 54 into a space provided between the adjoining joists 55. The joists 55 support the outer roofing, which is indicated generally at 56. The bent reinforcement bar 546 is, in turn, tied to yet another long, continuous, horizontal reinforcement bar 547, which is passed between the sides of bar 546 forming its apex and through each of the joists 55. Preferably, concrete is installed between the adjoining joists 55, either as part of the pour of the ring beam 54 or in a subsequent pour. Ends of the reinforcement rods 481–487 and 491–494 of columns 48 and 49 are also extended into the ring beam 54 and may be turned transversely to the vertical direction in the ring beam 54 to further lock the bars 481–487 and 491–494 into the ring beam 54. If desired, the joists 55 can be formed from steel beams to further strengthen the roofing 50 and to avoid the necessity of replacing the joists in the extremely unlikely chance they would be damaged. If desired, the ring beam 54 can be extended down near or to the tops of the wall openings such as doors or windows to replace lintels. Preferably, upper walls 41–44 are formed of concrete formed onto a wire frame and the exposed portion of the roofing is provided by ceramic tiles to eliminate all combustibles in the load-bearing components of the structure 10 and to provide strong, integral concrete walls. The preferred construction of structure 10, assuming it is placed on stable ground, will protect the structure from serious damage in a significant variety of potential natural calamities, including earthquake, brush fire, flood and insect attack, and further minimizes the need for structural maintenance.

Figure 5:
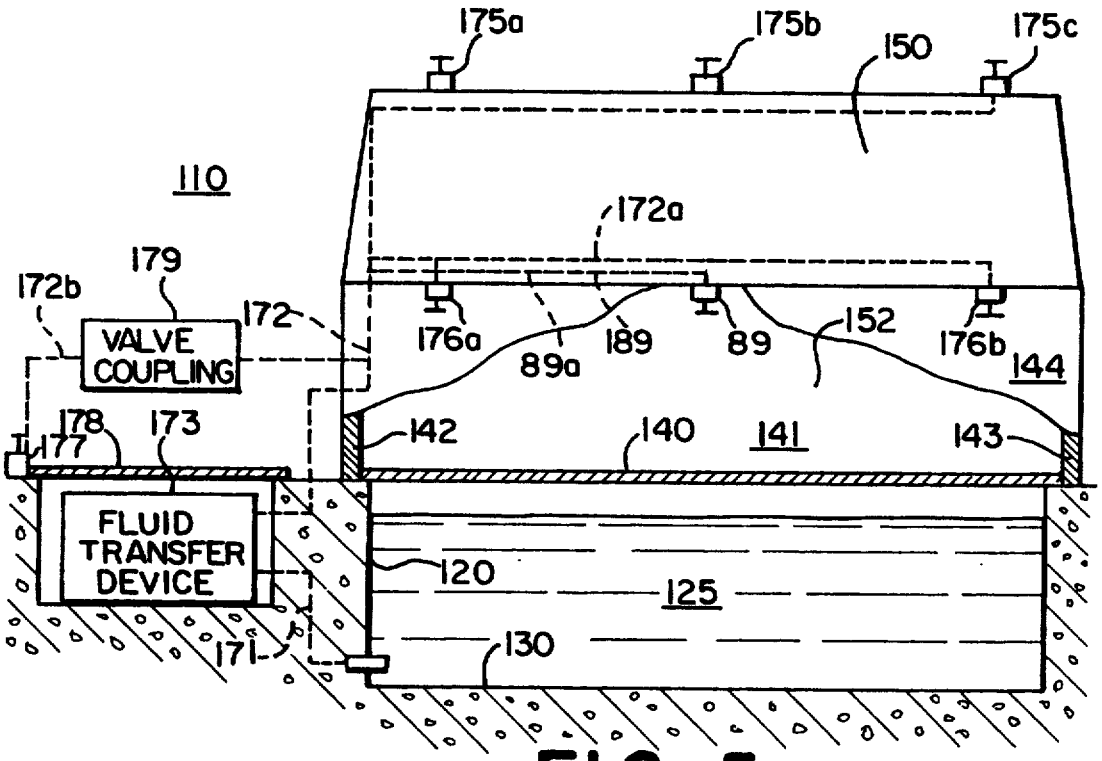
FIG. 5 depicts diagrammatically an alternate water distribution system for fire sprinklers in a ground-supported habitable structure of the present invention.

FIG. 5 depicts diagrammatically another ground-supported habitable structure embodiment of the present invention indicated generally at 110. Structure 110 includes a ground contacting foundation indicated generally at 120 with ground contacting, essentially water-impervious floor indicated generally at 130, flooring indicated generally at 140, which is positioned on the foundation 120, and roofing indicated generally at 150, which is exposed to the elements and supported sufficiently high over the flooring 140 to provide a habitable space 152 between the roofing 150 and flooring 140. Foundation 120 and floor 130 define an open top water enclosure 125. Roofing 150 is supported on the foundation 120 by four outer load bearing walls 141, 142, 143 and 144. A fluid transfer device 173, which is preferably a pump but may be any other device which can draw and adequately pressurize water for distribution, is fluidly coupled into a conduit system including a first part indicated diagrammatically by broken line 171 extending from an inlet of the fluid transfer device or "FTD" 173 to the interior of the enclosure 125 defined by the foundation 120 and floor 130, and a second part indicated diagrammatically by broken line 172, which extends from an outlet of the FTD 173 to a plurality of sprinklers **175*a*–175*c* spaced at regular intervals along the outer peak of the roofing 150, essentially above the roofing 150, on the outside of the structure. A branch of conduit 172, indicated by broken line 172*a* can be provided extending to sprinklers 176*a*, 176*b* positioned under the edges of the roofing 150 to spray water on the outer exposed surface of the outer load bearing wall 144 of the structure 110 and in a similar fashion on the outer surface of the opposing wall 141. Similarly, sprinklers (not depicted) can be placed beneath the edges or eaves of the roofing 150 over the remaining, outer load bearing walls 142 and 143 to spray water upon those as well. Another branch conduit, which is indicated by broken line 189 can be provided to service interior ceiling sprinklers 89, like the sprinklers 89 of the FIG. 1 structure 10. In addition or as an alternative, irrigation sprinklers can be provided on the ground like sprinkler 177, either at key locations or entirely around the structure, and coupled into the conduit system, preferably through a combined manual/automatic valve coupling 179. The valve coupling 179 might be a single valve in a single branch line 172*b*, which can be automatically operated, e.g. through a solenoid in response to a signal, and manually overwritten by means of a separate, manually operated signal generator, or a pair of valves, one manually operated and the other automatically operated. Sprinkler 177 and any like sprinklers would be positioned to spray water away from the structure 110 and onto the ground outside the structure to wet down any vegetation and impede the progress of a brush fire. Thus, the conduit system provided by conduits 171, 172 and the branches of either or both, fluidly coupled together the FTD 173, the interior of water enclosure 225 and the plurality of sprinklers 175*a*–175*c*, 176*a*–176*b*, 177 and 89. The fluid transfer device 173 can be located in a pit as depicted with an appropriate cover 178** for protection in the event of fire. Alternatively, an above-ground enclosure may be provided of heat insulative, non-combustible material(s).

In operation, the fire sprinkler system would operate in the same manner as a conventional boosted fire sprinkler system in that pressure would be maintained in conduit 172 and at each of the sprinklers **175*a*–175*c*, 176*a*–176*b*, 89, etc. and the activation of one or more of the sprinklers by exposure to sufficiently high temperatures would cause a lose of pressure in the line 172 triggering the activation of the fluid transfer device 173 to draw water from the enclosure 125 via the first conduit part 171 and to transmit it to any of the activated sprinklers through the second conduit part 172. Where freezing temperatures are a problem, the exposed sprinklers 175*a*–175*c* and 176*a*, 176*b* and any exposed portions of the conduit 172 may be incorporated into a dry sprinkler system part of which is pressurized with air until one of the sprinklers is triggered to activate the FTD 173. Alternatively, the exposed system can be drained of water during winter periods when there is no or very little threat of brush fire. Preferably, the automatic valve of coupling 179 would be controlled by a temperature sensor or by an array of sensors at different locations around the structure 110, or by a pressure sensor associated with line 172*b* if a dry system were used, to automatically open a valve of coupling 179 and line 172*b* to the sprinkler(s) 177. The sprinklers, wet or dry, could include thermally responsive sensors which generate a signal or conventional fire detectors or a pressure switch in line 172 could be provided to generate a signal which could be used to activate a prime mover or power supply associated with or forming part of the FTD 173. FTD 173 then pumps water in a conventional fashion from the enclosure 125** to any of the open sprinklers.

The provision of sprinklers on the exterior of the roofing and/or covering the exposed outer surfaces of the exterior load bearing walls of the structure 110 is believed to be a unique system for protecting housing in areas subject to brush fires, even if water is supplied in a conventional fashion from piped-in public water supplies, a well, a stream, etc. The same is true of activating irrigating sprinklers automatically by temperatures above possible ambient temperatures, which temperatures would indicate possible fire.

Figure 6:
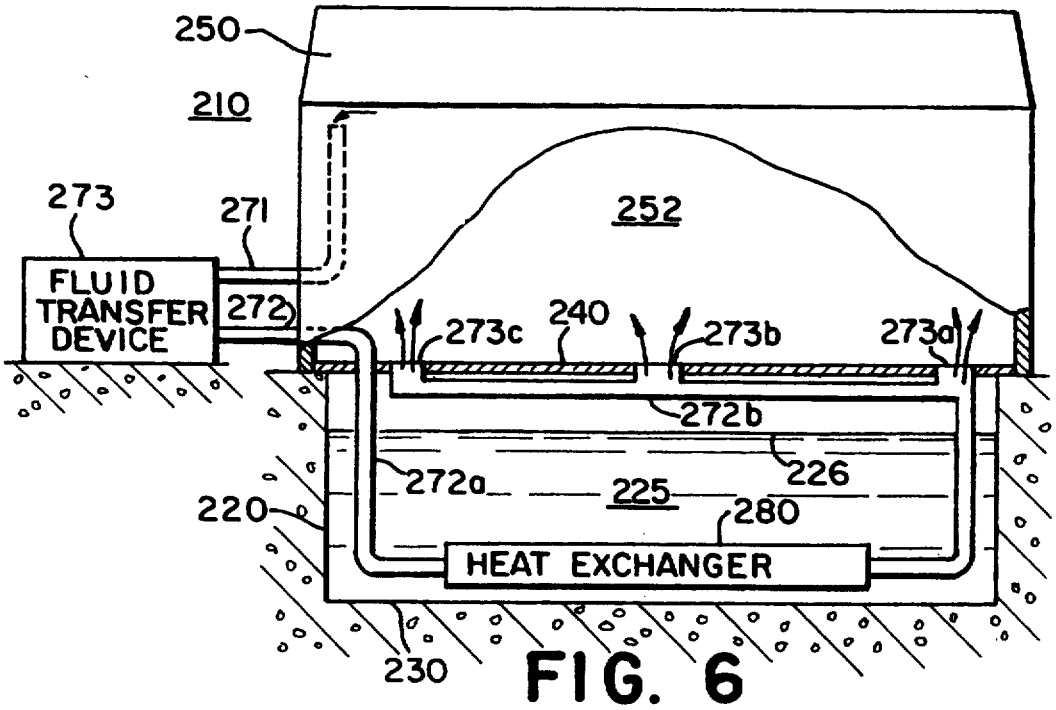
FIG. 6 depicts diagrammatically a first alternate water distribution system for heating and/or cooling of a ground-supported habitable structure of the present invention.
Figure 7:
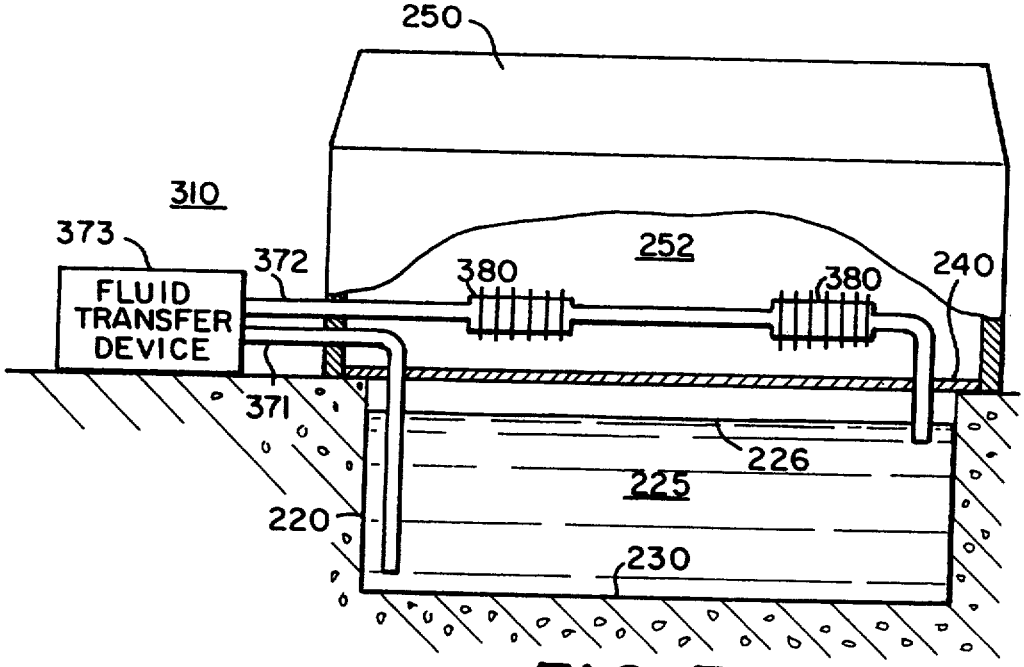
FIG. 7 depicts diagrammatically a second alternate water distribution system for heating and/or cooling of a ground-supported habitable structure of the present invention.
Figure 8:
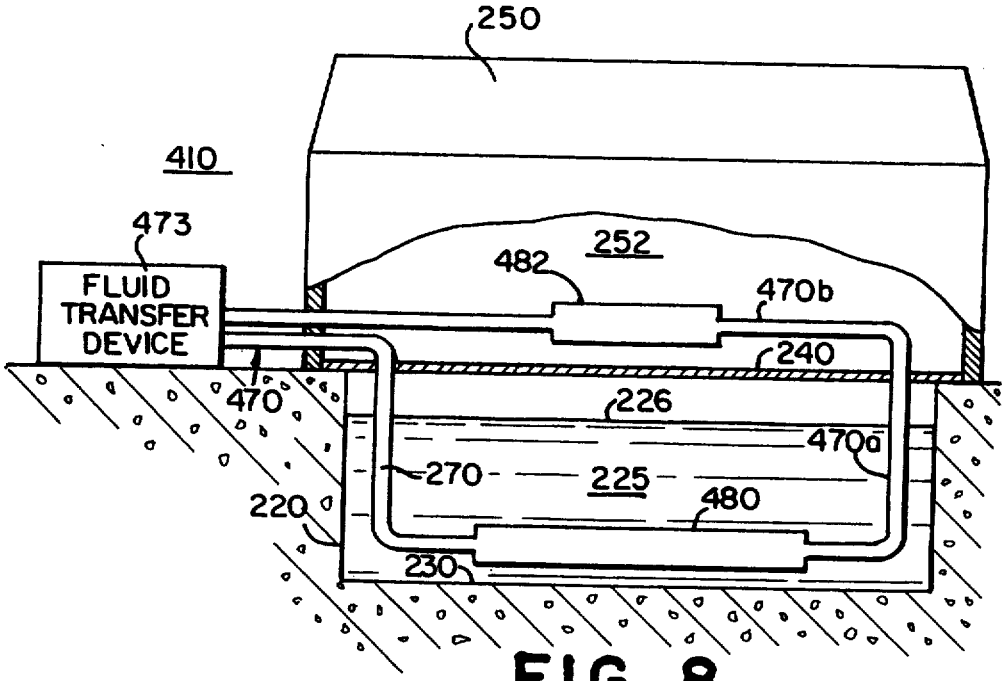
FIG. 8 depicts diagrammatically a third alternate water distribution system for heating and/or cooling of a ground-supported habitable structure of the present invention.

FIGS. 6 through 8 depict diagrammatically three different possible ways in which water stored in an enclosure formed by the foundation of the structure can be used to heat, and/or cool or assist in heating and/or cooling the interior of the structure. FIG. 6, depicts diagrammatically another structure embodiment 210 having a foundation 220 like foundations 20, 120 and floor 230 like floors 30, 130 together defining an open top water enclosure 225 like enclosure 125 beneath flooring 240 like flooring 40, 140, and roofing 250 like roofing 50, 150. A fluid transfer device 273 such as a fan having an inlet and outlet is fluidly coupled into a fluid conduit system comprising a first conduit 271 extending into the structure 210 to draw air to be heated or cooled from within the structure and a second conduit 272 which extends from the outlet of the fluid transfer device 273. The conduits 271 and 272 are thus fluidly coupled together into a system through fluid transfer device 273. A first part **272*a* of the conduit 272 extends through the open top water enclosure 225 below the level 226 of water in the enclosure 225. A second part 272*b* of the conduit 272 extends integrally and continuously from the first part 272*a* at a position below the roofing 250 and above the level 226 of any water in the enclosure 225, and, more particularly, the space which exists between the level 226 of the water and a lower surface of the flooring 240. Conventional air distributions ducts 273*a*, 273*b*, 273*c* can be provided at appropriate locations along the second part of the conduit 272*b* to permit the temperature treated air to enter the habitable portion 252 of the structure between the flooring 240 and the roofing 250. If desired, a conduit system could be extended from the indicated conduit 271 through the habitable areas of the house like conduit portion 272*b* and the fluid transfer device 273 be made to or be coupled in a way to reverse the indicated flow and distribution of air for more efficient heating or cooling. Important to this embodiment is the provision of at least one heat exchanger indicated diagrammatically at 280, which is fluidly coupled into the first part 272*a* of the conduit system below the level 226 of water in the enclosure 225. Each heat exchanger 280 is selected for efficient heat transfer between air passing through the conduit part 272*a* and the water in the enclosure 225. FTD 273 is thus coupled with the system defined by conduit parts 271, 272 in a manner to transfer air through at least the first and second parts 271, 272 of the conduit system and heat exchanger 280**.

FIG. 7 depicts diagrammatically yet another ground-supported habitable structure embodiment of the present invention indicated generally at 310. The structure differs from the structure 210 only in the heating/cooling distribution system. In FIG. 7, the preferred fluid transfer device 373 is a pump or other device suitable for transferring water through a conduit system which includes a first inlet conduit part 371 and a second outlet conduit part 372. FTD 373 is thus fluidly coupled with the conduit system in a manner to transfer water from enclosure 225 through at least the first and second parts 371, 372 and heat exchangers 380. One or more heat exchangers 380 are provided along conduit 372 in the interior of the structure 310 at some point between the roofing 250 and the level of water 226 within the open top enclosure 225, more particularly, in the habitable space provided above the flooring 240. In the embodiment of FIG. 7, the fluid transfer unit 373 draws water from within the enclosure 225 through inlet conduit 371 and discharges the water through outlet conduit 372 and heat exchanger(s) 380, which may be finned radiators, for example, as diagrammatically depicted, or any other known heat transfer devices suitable for this purpose, and returned to enclosure 225.

Lastly, FIG. 8 depicts another ground-supported habitable structure embodiment of the present invention indicated generally at 410 utilizing a third heating/cooling system. Structure 410 is the same as the structures of FIGS. 6 and 7 except for the differences in the heating/cooling system. In the structure 410, a closed circuit heat exchange system is depicted in which a suitable fluid transfer device 473 like a compressor or pump circulates a suitable heat transfer fluid through a closed fluid conduit system 470 having a first part indicated generally at **470*a*, which extends deeply into the enclosure 225 so as to be below the level 226 of water in the enclosure, and a second part, indicated generally at 470*b*, which is continuous with the portion 470*a* but is located somewhere in the space existing between the enclosure 225 and the roofing 250 above the level 226 of any water in the enclosure 225. In the closed system, at least a first heat exchanger 480 is located along the first part 470*a* of the conduit within the enclosure 225, preferably located near the bottom of the enclosure 225, to exchange heat with any water stored in the enclosure. At least a second heat exchanger 482 is located along the second part 470*b* of the conduit 470 so as to be located above the level 226 of water stored in the enclosure 225. The fluid transfer device 473 is coupled with the closed conduit system 470 in a manner to permit it to circulate a heat transferring fluid through the closed conduit system 470 and first and second heat exchangers 480 and 482 so as to draw heat from water in the enclosure 225 and release it into the interior 252 of the structure 410, or to draw heat from within the structure 410 and transfer it into water stored in the enclosure 225. The working fluid may simply remain in a single state like the air or water of the embodiments of FIGS. 6 and 7** or may be a refrigerant that can be vaporized and condensed over the range of temperatures expected to be encountered so as to operate the system like a heat pump using the enclosure water as the ambient environment.

It may be necessary or desirable to supplement the heating and/or cooling provided by any such system using stored water or to use such a system to supplement the operation of a conventional heating or heating/air conditioning system. Of course, variations on each of the water distribution systems shown in FIGS. 4 through 8 will be known to those of ordinary skill in the water sprinkler system design and installation arts and in the heating ventilation and air-conditioning arts, respectively. All such design using the water enclosures of the present invention are intended to be covered.

While preferred embodiments have been described and several modifications thereto suggested, those of ordinary skill in this art may recognize that further changes could be made and features added to the above-described embodiments of the invention, without departing from the broad, basic inventive concepts thereof. It should be understood, therefore, that the invention is not limited to the particular embodiments disclosed but covers any modifications which are within the scope and spirit of the invention as defined by the appended claims.

I claim:

1. A ground-supported habitable structure comprising:

a foundation formed by one or more essentially water-impervious vertical walls defining an essentially closed perimeter;

an essentially water-impervious floor within the perimeter supported on the ground, the floor and foundation defining an open top water enclosure sitting on or at least partially in the ground;

flooring positioned on the foundation at least substantially covering the open top of the enclosure, the foundation supporting the flooring and any load supported by the flooring;

roofing exposed to the elements and supported sufficiently high over the flooring to provide a habitable space between the roofing and the flooring, the roofing and any load supported by the roofing being transmitted to the ground through the foundation;

a plurality of fire sprinklers;

a fluid transfer device; and a conduit system fluidly coupling together the fluid transfer device, an interior of the water enclosure and the plurality of fire sprinklers so as to supply water to the sprinklers from the enclosure via the fluid transfer device.

2. The structure of claim 1 wherein at least one of said plurality of sprinklers is located beneath the roofing.

3. The structure of claim 1 wherein at least one of the plurality of sprinklers is located above the roofing, on the outside of the structure.

4. The structure of claim 1 further comprising an exposed, load-bearing outer wall located between the roofing and the foundation and wherein at least one of the plurality of sprinklers is located proximal the outer wall and is positioned to distribute water over an exposed outer surface of the outer wall.

5. The structure of claim 1 wherein at least one of the plurality of sprinklers is positioned to spray water away from the structure and onto ground outside the structure.

6. A ground-supported habitable structure comprising:

a foundation formed by one or more essentially water-impervious vertical walls defining an essentially closed perimeter;

an essentially water-impervious floor within the perimeter supported on the ground, the floor and foundation defining an open top water enclosure sitting on or at least partially in the ground;

flooring positioned on the foundation at least substantially covering the open top of the enclosure, the foundation supporting the flooring and any load supported by the flooring;

roofing exposed to the elements and supported sufficiently high over the flooring to provide a habitable space between the roofing and the flooring, the roofing and any load supported by the roofing being transmitted to the ground through the foundation;

a fluid conduit system including at least a first part extending through the open top water enclosure and at least a second part located at a position below the roofing and above a level of any water in the enclosure;

a heat exchanger fluidly coupled into at least one of the first and second parts of the conduit system; and a fluid transfer device fluidly coupled with the conduit system in a manner to transfer a fluid through at least the first and second parts of the conduit system and the heat exchanger.

7. A ground-supported habitable structure comprising:

a foundation formed by one or more essentially water-impervious vertical walls defining an essentially closed perimeter;

an essentially water-impervious floor within the perimeter supported on the ground, the floor and foundation defining an open top water enclosure sitting on or at least partially in the ground;

flooring positioned on the foundation at least substantially covering the open top of the enclosure, the foundation supporting the flooring and any load supported by the flooring;

roofing exposed to the elements and supported sufficiently high over the flooring to provide a habitable space between the roofing and the flooring, the roofing and any load supported by the roofing being transmitted to the ground through the foundation;

a closed fluid conduit system having a first part extending into the enclosure and a second part within the structure in a space existing between the enclosure and the roofing above any water in the enclosure;

at least a first heat exchanger located along the first part of the conduit system in a position within the enclosure to exchange heat with water stored in the enclosure;

at least a second heat exchanger located along the second part of the conduit system in a position above any water stored in the enclosure; and a fluid transfer device coupled with the closed fluid conduit system in a manner to circulate a heat transfer fluid through the closed fluid conduit system and first and second heat exchangers.

8. A habitable structure with water storage and distribution comprising:

a building including at least a roof and exterior side walls;

a catchment positioned to collect at least rain water from the roof;

a plurality of water sprinklers supported from the building; and a covered water enclosure within the building fluidly coupled with the catchment and with the plurality of sprinklers.

9. The structure of claim 8 further comprising a powered fluid transfer device fluidly coupled with the covered water enclosure.

10. The structure of claim 8, wherein the plurality of sprinklers are located on the building exterior.

11. The structure of claim 9, wherein the plurality of sprinklers are located on the building exterior.

12. The structure of claim 8 wherein the plurality of sprinklers are located within the building.

13. The structure of claim 9 wherein the plurality of sprinklers are located within the building.

14. The structure of claim 9 further comprising an auxiliary power supply coupled with the fluid transfer device.

15. In combination with a habitable structure including a roof and exterior side walls surrounding a habitable space, an improvement comprising:

a catchment positioned to collect at least rain water from the roof;

a covered water enclosure fluidly coupled with the catchment;

a plurality of fire sprinklers supported on the building and fluidly coupled with the covered water enclosure.

16. The improvement of claim 15 wherein the covered water enclosure is located within the building.

17. The improvement of claim 15 further comprising a powered fluid transfer device fluidly coupled with the covered water enclosure.

18. The improvement of claim 17 further comprising an auxiliary power supply coupled with the fluid transfer device.

* * * * *